US005784732A

United States Patent [19]

Vail

[11] Patent Number: 5,784,732

[45] Date of Patent: Jul. 28, 1998

[54] SIDE RAIL FOR A BED ENCLOSURE

[76] Inventor: Robert L. Vail, 6213 Cedar Point Rd., Oregon, Ohio 43618

[21] Appl. No.: 838,749

[22] Filed: Apr. 9, 1997

[51] Int. Cl.[6] ..... A47C 21/08

[52] U.S. Cl. ..... 5/430; 5/424; 16/350; 16/361

[58] Field of Search ..... 5/424, 425, 428, 5/430, 100; 16/345, 346, 347, 348, 350, 351, 352, 353, 357, 360, 361, 362, 363

[56] References Cited

U.S. PATENT DOCUMENTS

| | | | |
|---|---|---|---|
| 677,671 | 7/1901 | Lausen | 5/430 |
| 4,215,446 | 8/1980 | Mahoney | 5/425 |
| 4,672,698 | 6/1987 | Sands | 5/100 |
| 5,044,025 | 9/1991 | Hunsinger et al. | 5/424 |
| 5,191,663 | 3/1993 | Holder et al. | 5/425 X |
| 5,384,925 | 1/1995 | Vail | 5/424 |
| 5,596,776 | 1/1997 | Huang | 5/425 X |

FOREIGN PATENT DOCUMENTS

| | | | |
|---|---|---|---|
| 1441786 | 7/1976 | United Kingdom | 5/430 |

OTHER PUBLICATIONS

Copy of page from Brochure entitled "Confidential Dealer Price List", distributed by Omni Healthcare, dated Feb. 15, 1993.

Copy of pages from Brochure distributed by Hill-Room, copyright date 1988.

Copy of page from Brochure entitled "Standard Extended Care Beds", Form No. 91-72, distributed by Invacare Corporation, revision date of Sep. 1991.

Copy of page from Brochure entitled "Deluxe Models Only, Standard Extended Care Beds, Accessories and Options", Form No. 89-152, distributed by Invacare Corporation, revision date of Apr. 1991.

Copy of pp. 2, 3, 5, 18, 20, and 21 from Parts and Service Manual entitled "Maxi-Mate & Multi-Mate Beds", distributed by Simmons Company, copyright date 1969.

*Primary Examiner*—Michael F. Trettel

*Attorney, Agent, or Firm*—MacMillan, Sobanski & Todd, LLC.

[57] ABSTRACT

A bed enclosure is provided with a side rail which is movably mounted to a frame of the bed enclosure by a hinge assembly. The hinge assembly allows the side rail to pivotally move between a raised position, in which the side rail is adjacent a side of a mattress supported by the frame, and a lowered position, in which the said rail is below a top surface of the mattress, thereby permitting a person to easily enter and exit the bed enclosure. The hinge assembly retains the side rail in a locked position flush against the side of the mattress so that there is substantially no gap between the side rail and the side of the mattress when the side rail is in the raised position. The hinge assembly can be manually operated to disengage the side rail from the raised position to pivot the side rail in a direction outwardly from the side of the mattress to the lowered position. In accordance with another embodiment of the invention, a hinge assembly is provided with a spring assembly to help retain the side rail in the locked position.

20 Claims, 7 Drawing Sheets

SIDE RAIL FOR A BED ENCLOSURE

BACKGROUND OF THE INVENTION

This invention relates in general to bed enclosures and in particular to an improved side rail for use with such a bed enclosure.

In medical treatment situations, it is sometimes necessary (or preferred) to physically restrain certain patients in order to provide protection for themselves and/or others. For example, adults and children having dementia, psychiatric or mental disorders, or other kinds of mental and/or physical problems may need to be restrained. In the past, these people have been physically restrained by using ties, straps, or vests. However, the use of these kinds of restraints can cause severe discomfort and can impede emergency treatment. In addition, these kinds of restraints must frequently be removed during the day for a variety of reasons, such as to allow the person to exercise his or her muscles, or to clean or feed the person.

One alternative to using physical restraints involves using a bed enclosure. Typically, the bed enclosure includes a supporting framework and a netted covering which is fitted over the sides and top of the framework. The netted covering is provided with zippered areas which can be readily opened and closed in order to provide access to the interior of the enclosure. Thus, the bed enclosure provides a more humane, safe, and less restrictive environment for the person.

Generally, bed enclosures include side rails which are positioned adjacent the side edges of the mattress and extend upwardly past the top surface of the mattress. The side rails help prevent the person inside the bed enclosure from moving past the side edges of the mattress, such as when the person is moving or rolling around while sleeping. The side rails are often padded for added comfort. Preferably, at least one side rail is mounted on the frame of the bed enclosure such that the side rail can be lowered to a position beneath the top surface of the mattress, thereby allowing a person to easily enter and exit the bed enclosure.

One kind of known side rail is mounted so that the side rail can be moved vertically between a lowered position and a raised position. Some of these side rails are mounted so that the side rail is moved vertically upward by a sliding engagement between a pair of rails mounted on the side rail. Other known side rails are pivotally mounted such that the side rail is pivoted upward along the side of the mattress so that the side rail remains the same distance from the side of the mattress when moved from the lowered to the raised position. These prior art side rails are typically moved manually into the desired position. Unfortunately, a gap exists between the mattress and the side rails so that the side rail does not scrape along the side edge of the mattress when the side rail is raised or lowered. The gap is undesirable because a limb of a person in the bed enclosure could get wedged or caught between the side rail and the edge of the mattress, thereby possibly causing injury to the person. Thus, it would be desirable to have an improved side rail for use with a bed enclosure which is positioned substantially flush against the mattress when the side rail in the raised position to prevent persons limbs from getting wedged or caught therein.

BRIEF SUMMARY OF THE INVENTION

This invention relates to an improved bed enclosure having a side rail pivotally mounted by means of a hinge assembly to a frame of the bed enclosure which allows the side rail to move from a raised position to a lowered position. In the raised position, the hinge assembly retains the side rail in a locked position flush against the side of the mattress so that there is substantially no gap between the side rail and the side of the mattress. In the lowered position, the said rail is below a top surface of the mattress, thereby permitting a person to easily enter and exit the bed enclosure.

The hinge assembly includes a first member which is fastened to the frame of the bed enclosure. The hinge assembly further includes a second member which is fastened to side rail. The second member has a first slot formed therein which extends in a first direction. The second member also has a second slot formed therein having a first branch and a second branch. The first branch extends in the first direction. The second branch extends from the first branch to a side of the second member to form an opening in the second slot. A first pin is fastened to the first member and extends outwardly therefrom. The first pin is slidably disposed within the first slot. The second member is pivotable about the first member by the cooperation of the first pin and the first slot. A second pin is fastened to the first member and extends therefrom. The second pin is slidably disposed within the second slot when the side rail is in the raised position. When the side rail is moved from the raised position to the lowered position, the second pin is directed through the opening in the second slot. Preferably, the second member includes a recess formed in the first branch of the second slot which generally extends in a second direction perpendicular to the first direction. The side rail is movable to a raised locked position in which the side rail is flush against the mattress and the second pin is positioned within the recess so that the side rail cannot be directly pivoted to the lowered position. To disengage the side rail from the raised locked position, the side rail is moved against the side of the mattress to compress the mattress, thereby moving the second pin out from the recess so that the side rail can then be pivoted to the lowered position by directing the second pin through the opening in the second slot.

In a specific embodiment of the hinge assembly, a spring assembly is incorporated therein to assist in retaining the second pin in the recess while the side rail is in the raised locked position. The spring assembly includes a resilient spring strap supported between a pair of mounting pins which are fastened to the second support member. A central portion of the spring strap is positioned adjacent the second pin so that the second pin is sandwiched between the spring strap and the wall of the recess.

Various objects and advantages of this invention will become apparent to those skilled in the art from the following detailed description of the preferred embodiment, when read in light of the accompanying drawings.

DETAILED DESCRIPTION OF THE INVENTION

Figure 1:
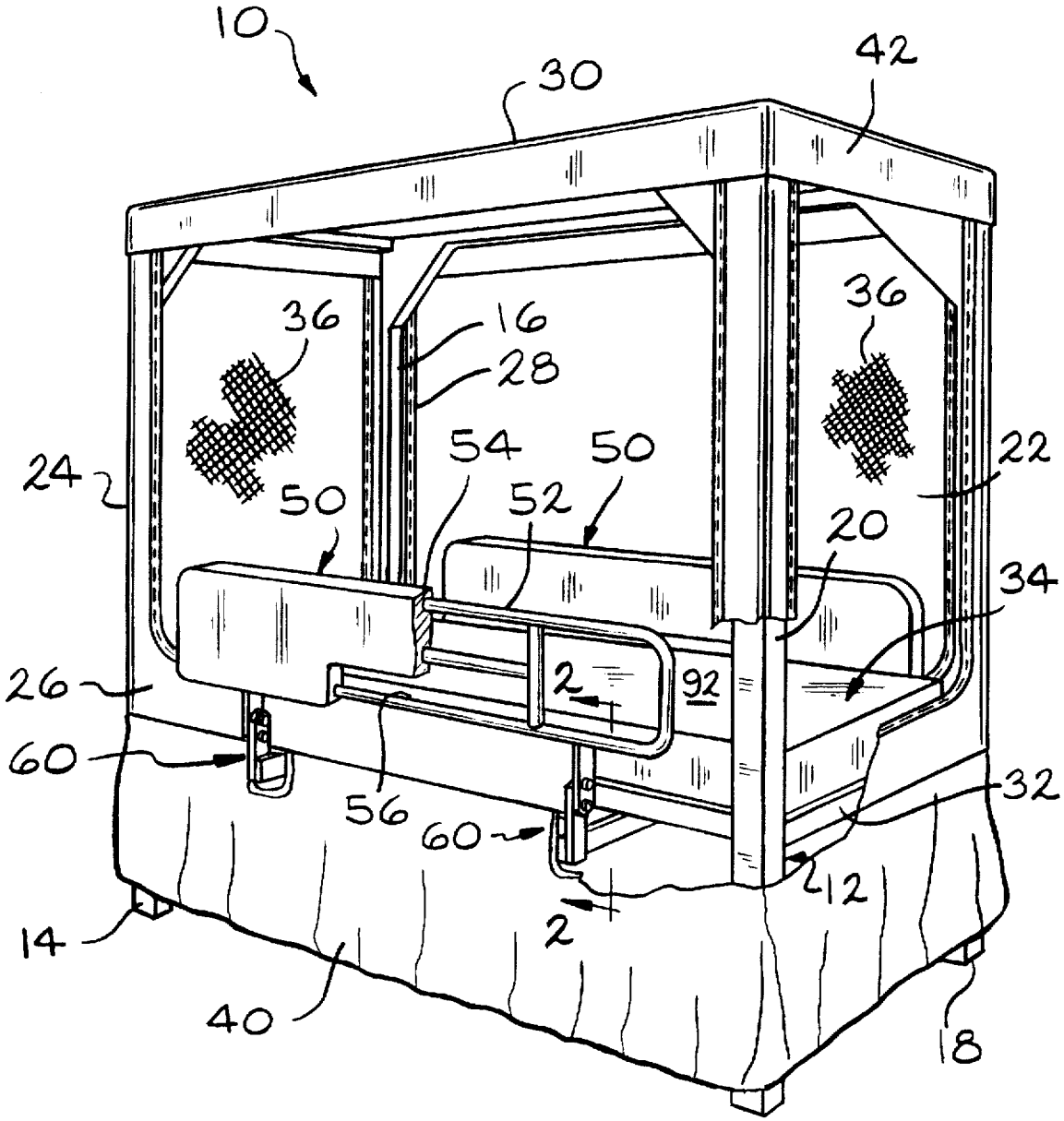
FIG. 1 is a perspective view of a bed enclosure including an improved side rail in accordance with the invention, wherein the bed enclosure and the side rail are partially broken away for clarity.

In the following description of the invention, certain terminology will be used for the purpose of reference only, and is not intended to be limiting. Terms such as "upper", "lower", "above", "below", "rightward", "leftward", "clockwise", and "counterclockwise" refer to directions in the drawings to which reference is made. Terms such as "inward" and "outward" refer to directions toward and away from, respectively, the geometric center of the component described. Terms such as "front", "rear", "side", "leftside", "rightside", "top", "bottom", "horizontal", and "vertical" describe the orientation of portions of the component within a consistent but arbitrary frame of reference which is made clear by reference to the text and the associated drawings describing the component under discussion. Such terminology will include the words specifically mentioned above, derivatives thereof, and words of similar import.

Referring now to the drawings, there is illustrated in FIG. 1 a bed enclosure, indicated generally at 10, in accordance with the invention. The bed enclosure 10 comprises a generally rectangular shaped frame 12 having four upright posts 14, 16, 18, and 20. The frame 12 defines a pair of opposed ends 22 and 24, a pair of opposed sides 26 and 28, and a top 30. The frame 12 includes a horizontally extending bed 32 which is supported by the four upright posts 14, 16, 18, and 20. The bed 32 supports a mattress 34 resting on top of the bed 32. The upper portion of the frame 12 is covered by a netting 36, thereby enclosing the ends 22 and 24, the sides 26 and 28, and the top 30. The netting 36 on the sides 26 and 28 includes zippered access openings for entering and exiting the bed enclosure 10. Preferably, the upright posts 14, 16, 18, and 20 and the interior of the enclosure bed 10 are covered by padding. Preferably, the bed enclosure 10 also includes a skirting 40 surrounding the lower portion of the frame 12, thereby concealing the underside of the bed 32 from view. In addition, a removable upper cover 42 is placed around the upper portion of the frame 10.

The bed enclosure 10 further includes a side rail 50 which is pivotally mounted on the frame 12. The bed enclosure 10 can include multiple side rails 50, for example, one side rail 50 on each of the sides 26 and 28 of the bed enclosure 10. The bed enclosure 10 can also have multiple independently pivotable side rails 50 on the same side 26 or 28. If desired, the bed enclosure 10 can also include side rails 50 at the ends 22 and/or 24 of the bed enclosure 10. The side rail 50 is constructed of a framework 52, as best seen in FIG. 1, comprised of any suitable rigid material, such as metal tubing. Preferably, the framework 52 of the side rail 50 is covered by a padding 54. If desired, a portion of the framework 52 of the side rail 50 can be exposed to provide for a gripping location 56 to manually raise and lower the side rail 50, as will be explained in detail below.

The side rail 50 is pivotally mounted on the frame 12 by a pair of hinge assemblies, generally indicated at 60. The pair of hinge assemblies 60 are essentially identical in structure and function, but can be manufactured as mirror images, or left and right components, of each other. The side rail 50 can have a single hinge assembly 60 or any multiple number of hinge assemblies 60.

Figure 2:
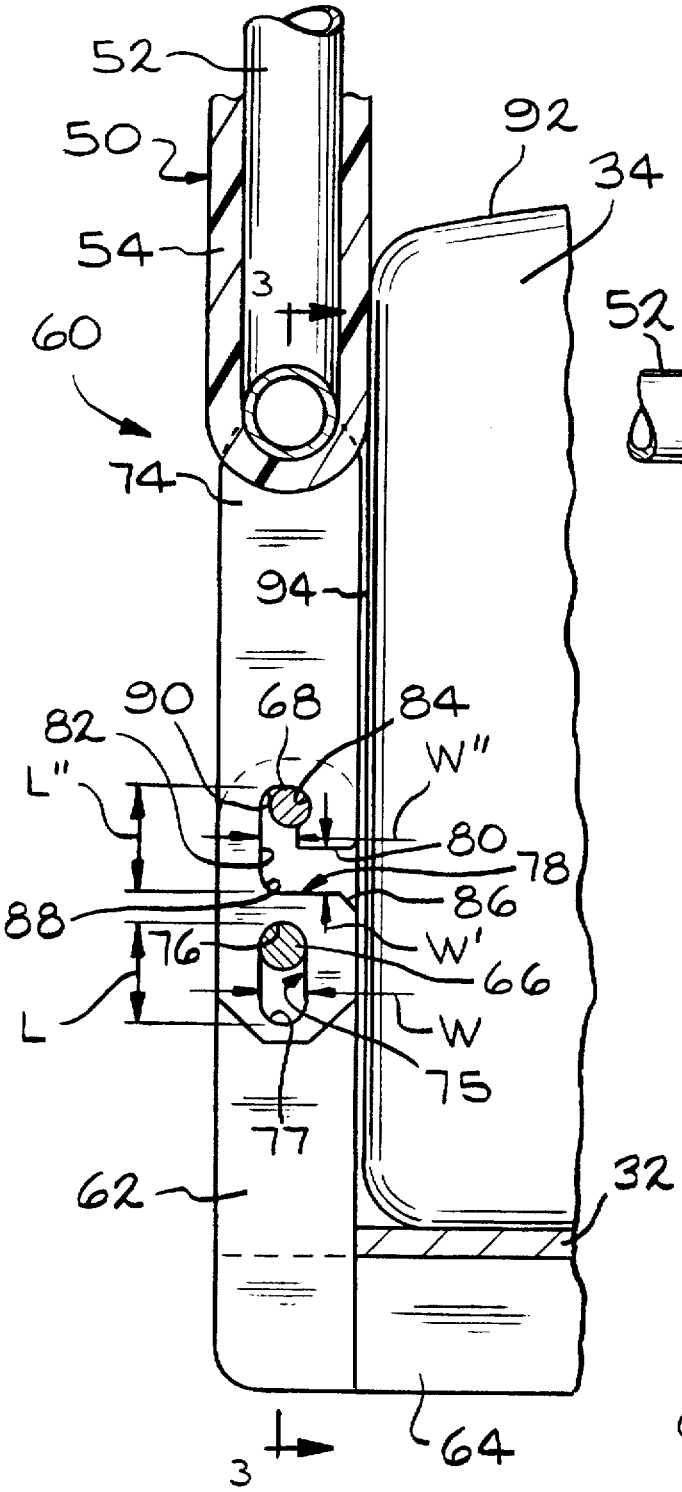
FIG. 2 is a partial cross-sectional view of the side rail taken along lines 2—2 of FIG. 1, illustrating a first embodiment of a hinge assembly therefore, wherein the hinge assembly is in a raised locked position.
Figure 3:
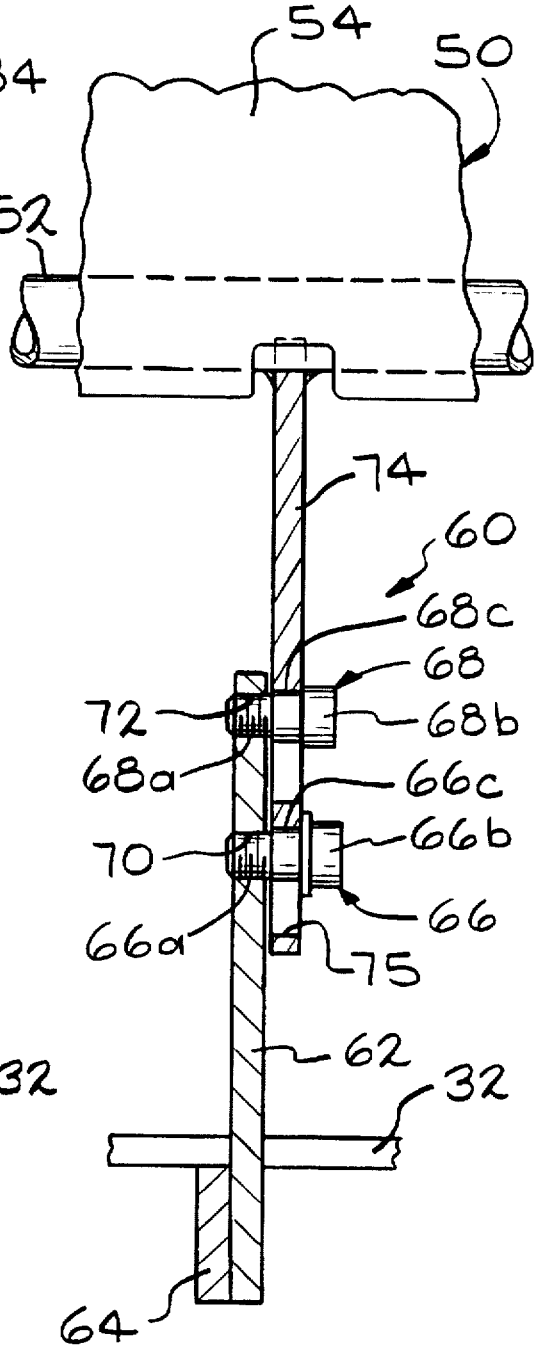
FIG. 3 is a sectional view of the hinge assembly taken along lines 3—3 of FIG. 2.

As best seen in FIGS. 2 and 3, the hinge assembly 60 includes a first support member 62 extending vertically upward from a rail 64. The first support member 62 can be fastened to the rail 64 by any suitable method, such as by a weld (not shown). The rail 64 extends outwardly from the side 26 or 28 of the bed enclosure and is fastened to the bed 32 by any suitable method, such as by threaded fasteners (not shown). A lower pin 66 and an upper pin 68 are fastened to the first support member 62 and extend outwardly therefrom.

The lower and upper pins 66 and 68 can be fastened to the first support member 62 by any suitable method, such as by threadably fastening threaded portions **66*a* and 66*b* of the pins 66 and 68, respectively, to respective internally threaded bores 70 and 72 formed in the first support member 62. The pins 66 and 68 preferably include radially outwardly extending heads 66*b* and 68*b*, respectively, and intermediate portions 66*c* and 68*c*, respectively, formed between the threaded portions 66*a* and 66*b* and the heads 66*b* and 68*b***.

The hinge assembly 60 further includes a second support member 74 which is attached to the framework 52 of the side rail 50 and extends vertically downwardly therefrom, as shown in FIGS. 2 and 3. The second support member 74 can be attached to the framework 52 by any suitable means, such as by a weld (not shown). The second support member 74 has an elongated closed slot 75 formed therethrough. The lower pin 66 is slidably disposed within the closed slot 75, such that the intermediate portion **66*c* of the lower pin 66 slidably engages the wall of the closed slot 75. As will be discussed in detail below, the closed slot 75 and the lower pin 66 cooperate to allow the second support member 74 to pivot about lower pin 66. The closed slot 75 is generally elongated in a vertical direction, as shown in FIG. 2, and defines a length L and a width W. The closed slot 75 has an upper portion 76 and a lower portion 77. The width W of the closed slot 75 is preferably slightly larger than the diameter of the intermediate portion 66*c* of the lower pin 66. The head 66*b* of the lower pin 66 preferably has a larger diameter than the width W of the closed slot 75 so that the second support member 74 is pivotally retained adjacent the first support member 62. If desired, a washer (not shown) can be inserted around the lower pin 66 for reduced frictional contact between the second support member 74 and the first support member 62 when the second support member 74 of the side rail 50 is pivoted about the lower pin 66**.

The second support member 74 has a multi-directional open slot 78 formed therethrough. The upper pin 68 is slidably disposed within the open slot 78, such that the intermediate portion **68*c* of the pin 68 slidably engages the walls of the open slot 78. The open slot 78 includes first and second branches 80 and 82 and a recess 84. As viewing FIG. 2, the first branch 80 is generally elongated in a horizontal direction and extends through the right side of the second support member 74, thereby forming an opening 86. The first branch 80 defines a width W' which is preferably slightly larger than the diameter of the intermediate portion 68*c* of the upper pin 68. The second branch 82 is generally elongated in a vertical direction, as viewed in FIG. 2, and defines a length L" and a width W" which is preferably slightly larger than the diameter of the intermediate portion 68c or the upper pin 68. Preferably, the second branch 82 extends in a direction perpendicular to the first branch 80. The second branch 82 has a lower portion 88 which communicates with the first branch 80. The recess 84 extends rightwardly, as viewed in FIG. 2, from an upper portion 90 of the second branch 82**.

Figure 5:
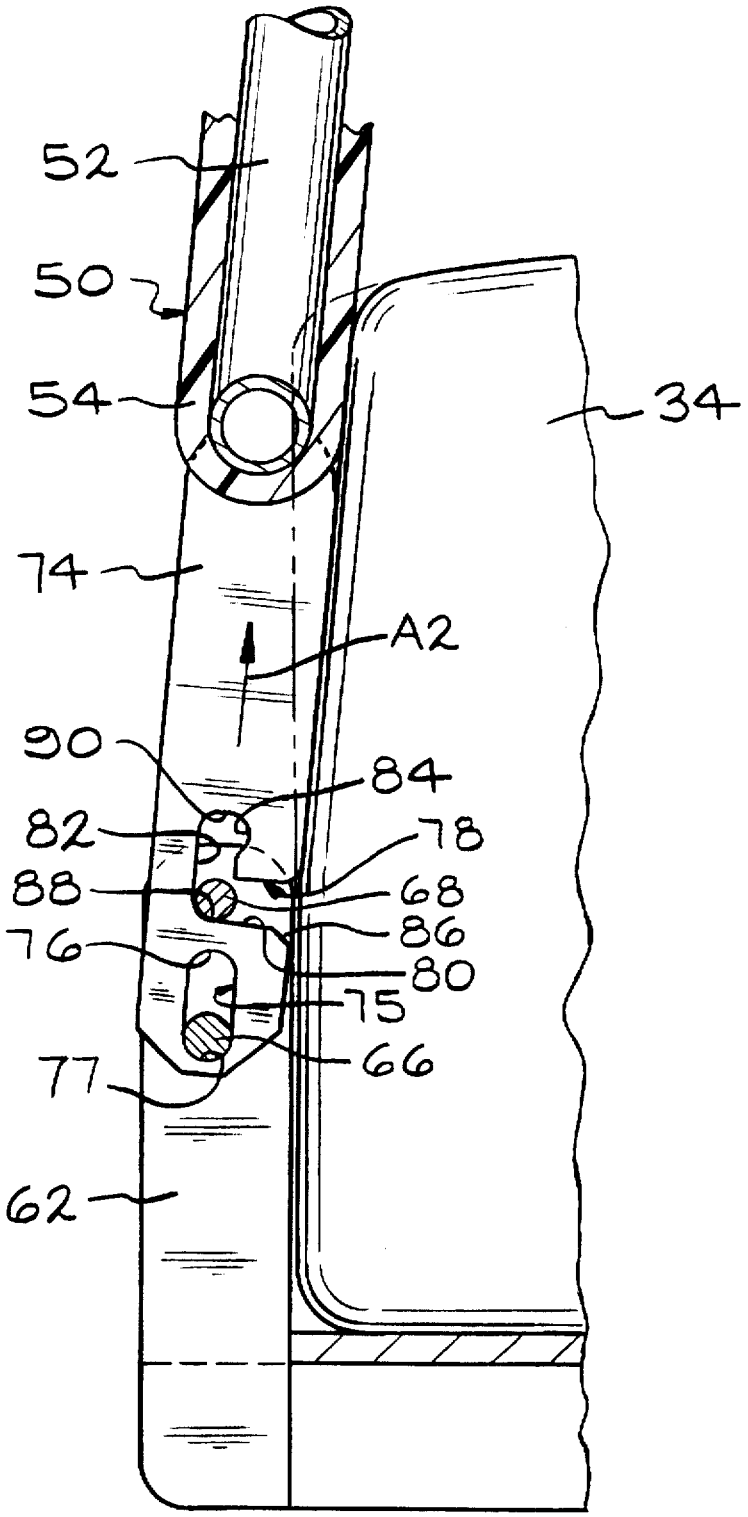
FIG. 5 is a sectional view of the side rail showing the hinge assembly of FIG. 2 in a pivoted lifted position against the mattress.
Figure 6:
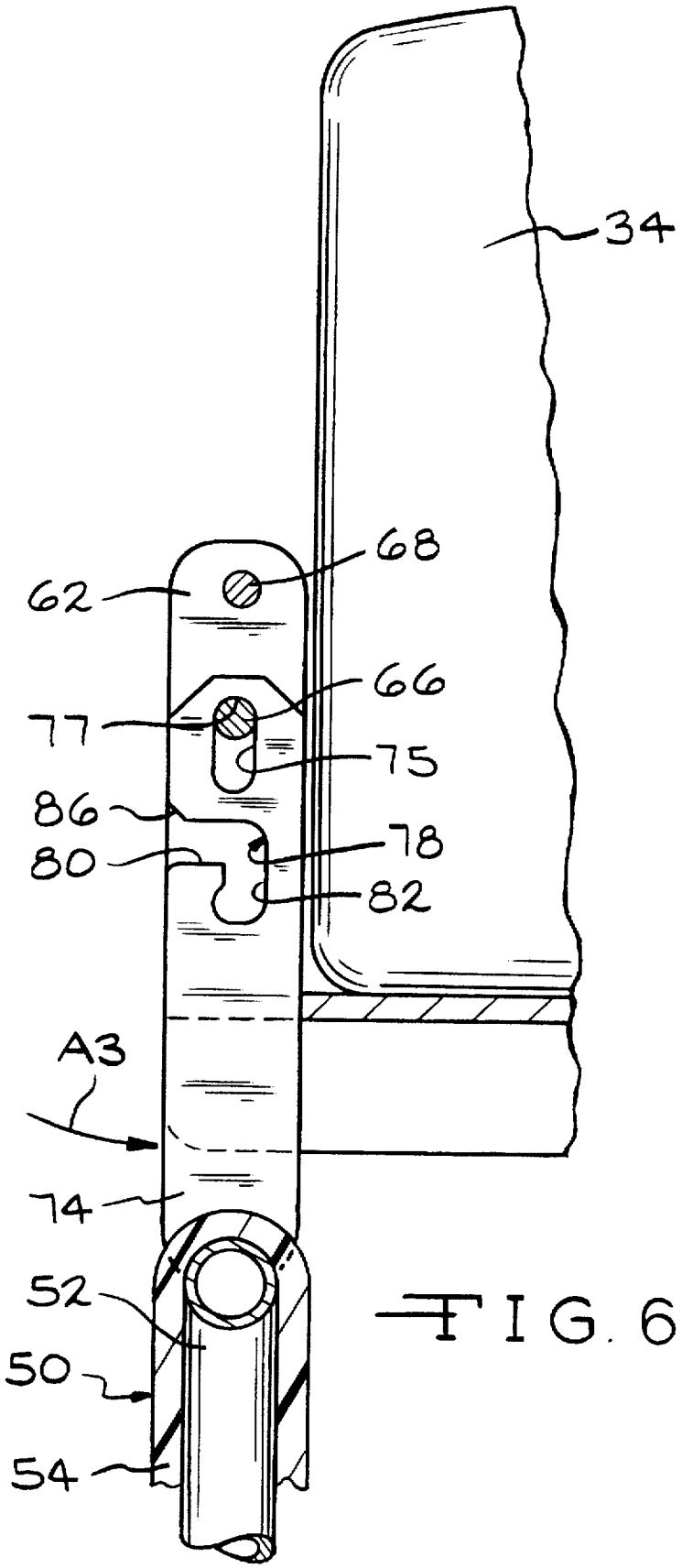
FIG. 6 is a sectional view of the side rail showing the hinge assembly of FIG. 2 in a pivoted lowered position.

The hinge assembly 60 enables the side rail 50 to be movable between a first or raised position, as shown in FIG. 1, to a second or lowered position, as shown in FIG. 6. When in the raised position, the side rail 50 extends upwardly above a top surface 92 of the mattress 34. The side rail 50 being in the raised position helps prevent a person inside the bed enclosure 10 from moving or rolling past a side edge 94 of the mattress 34. The side rail 50, as shown in FIGS. 1 through 3, is in a raised locked position such that the side rail 50 cannot be directly rotated into the lowered position, as will be discussed in detail below. The side edge 94 of the mattress 34 is positioned adjacent the side rail 50 and preferably is in contact therewith or is positioned such that there is substantially no gap between the side edge 94 of the mattress 34 and the side rail 50. The term "substantially no gap", as used herein, means a gap small enough to prevent a limb or other body part of a person from being wedged or caught between the side rail 50 and the side edge 94 of the mattress 34. If a sufficiently large gap existed between the side rail 50 and the side edge 94 of the mattress 34, a limb of a person could be easily wedged therebetween by only slight compression of the side edge 94 of the mattress 34, thereby possibly leading to injury. Note the netting 36 has been removed in FIGS. 2 through 8 for clarity.

As shown in FIG. 2, the side rail 50 is in the locked raised position, wherein the side edge 94 of the mattress 34 is adjacent the side rail 50. In this position, the side rail 50 is prevented from pivoting in a direction away from the side edge 94 of the mattress due to the contact between the intermediate portion 68c of the upper pin 68 and the wall of the recess 84 formed in the second support member 74. The side rail 50 is prevented from moving vertically downward due to the contact between the lower pin 66 and the wall of the closed slot 75. The side rail 50 is also prevented from moving in an vertically upward direction due to the contact between the upper pin 68 and the wall of the recess 84.

Figure 4:
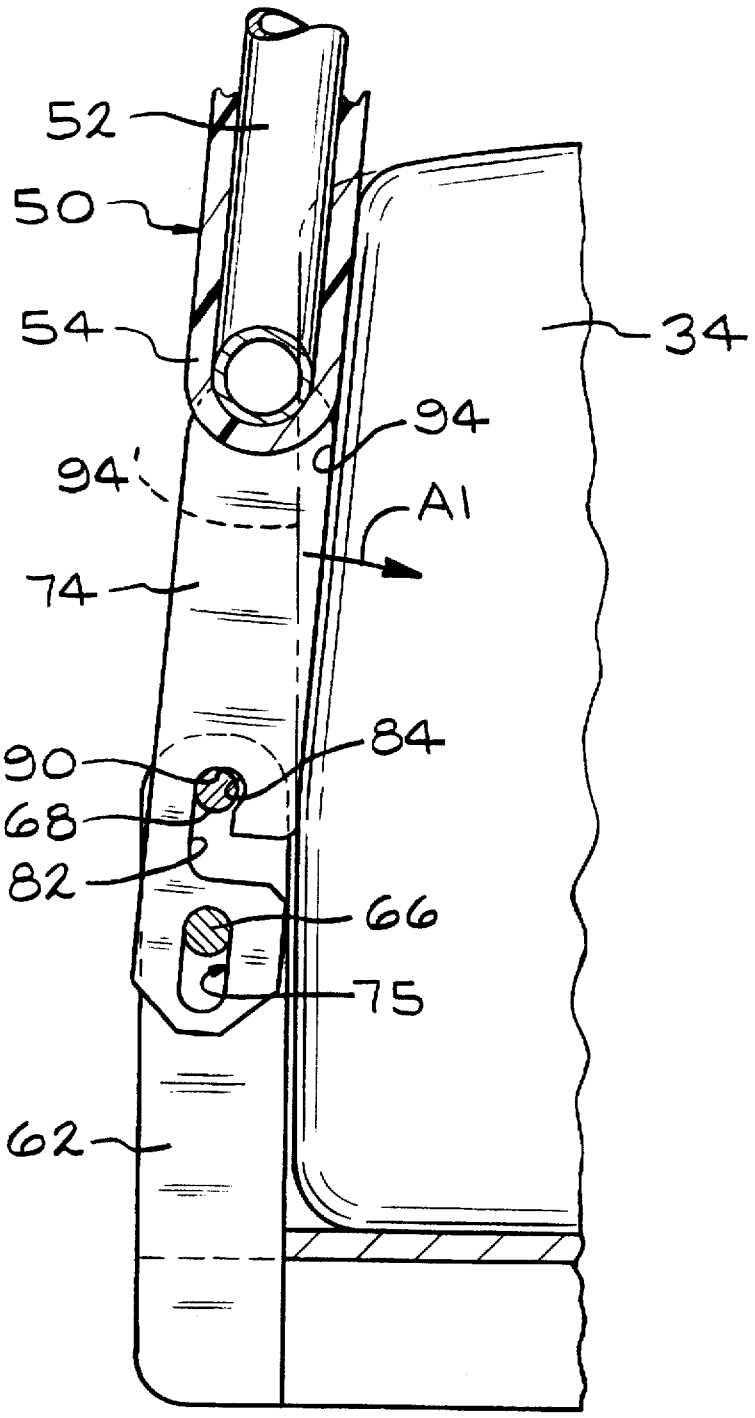
FIG. 4 is a sectional view of the side rail showing the hinge assembly of FIG. 2 in a pivoted unlocked position against the mattress of the bed enclosure.

To disengage the side rail 50 from the raised locked position, the side rail 50 is first rotated in a clockwise direction denoted by arrow A1, as viewing FIG. 4, pivoting about the lower pin 66 so that the side edge 94 of the mattress 34 is compressed by the side rail 50, as illustrated in FIG. 4. Note that in FIG. 4, the original uncompressed position of the side edge 94 of the mattress 34 is represented by phantom lines 94'. When the side rail 50 is rotated to the position illustrated in FIG. 4, the side rail 50 is said to be in an unlocked position. In the unlocked position, the second support member 74 is moved so that the upper pin 68 is positioned within the upper portion 90 of the second branch 82 of the open slot 78.

The side rail 50 can then be lifted in a generally vertical direction to a lifted position denoted by arrow A2, as illustrated in FIG. 5. In the lifted position, the second support member 74 is moved so that the upper pin 68 is positioned within the lower portion 88 of the second branch 82. Also, the lower pin 66 is positioned within the lower portion 77 of the closed slot 75.

Finally, the side rail 50 is rotated such that the second support member 74 of the side rail 50 is pivoted about the lower pin 66 denoted by arrow A3 until the side rail 50 is in a lowered position, as illustrated in FIG. 6. During initial rotation of the side rail 50, the upper pin 68 is directed through the first branch 80 and out through the opening 86 of the open slot 78. Preferably, the length L of the closed slot 75 is approximately equal to the length L' of the second branch 82 of the open slot 78 so that when the side rail 50 is lifted upwardly from the unlocked position, the lower pin 66 contacts the lower portion 77 of the closed slot 75, and the upper pin 68 is aligned with the first branch 80 of the open slot 78. If desired, the width W' of the first branch 80 can be formed large enough to allow the upper pin 68 to travel in an arcuate path during the rotational movement of the side rail 50 from the lifted position to the lowered position. The mattress 34 is uncompressed back to its original state when the side rail 50 is moved from the lifted position to the lowered position.

To move the side rail 50 from the lowered position, as illustrated in FIG. 6, to the raised position, as illustrated in FIG. 2, the side rail 50 is generally moved in reverse order of the steps described above. First, the side rail 50 is rotated about the lower pin 66 until the side rail 50 is in the lifted position, as illustrated in FIG. 5 so that the side edge 94 of the mattress 34 is slightly compressed by the side rail 50 when moved to the lifted position, as illustrated in FIG. 5. The side rail 50 is then moved generally downward to the unlocked position, as illustrated in FIG. 4. The compressive force from the mattress 34 will then assist in slightly rotating the side rail 50 to the raised locked position, as illustrated in FIG. 2.

Although the closed slot 75 and the first and second branches 80 and 82 of the open slot 78 are described as having a generally straight elongated shape, they could be formed into any suitable shape, such as a curved or tapered shape. It should also be understood that although the hinge assembly 60 of the present invention was described with respect to the bed enclosure 10, the hinge assembly 60 can be used with other kinds of beds.

Figure 7:
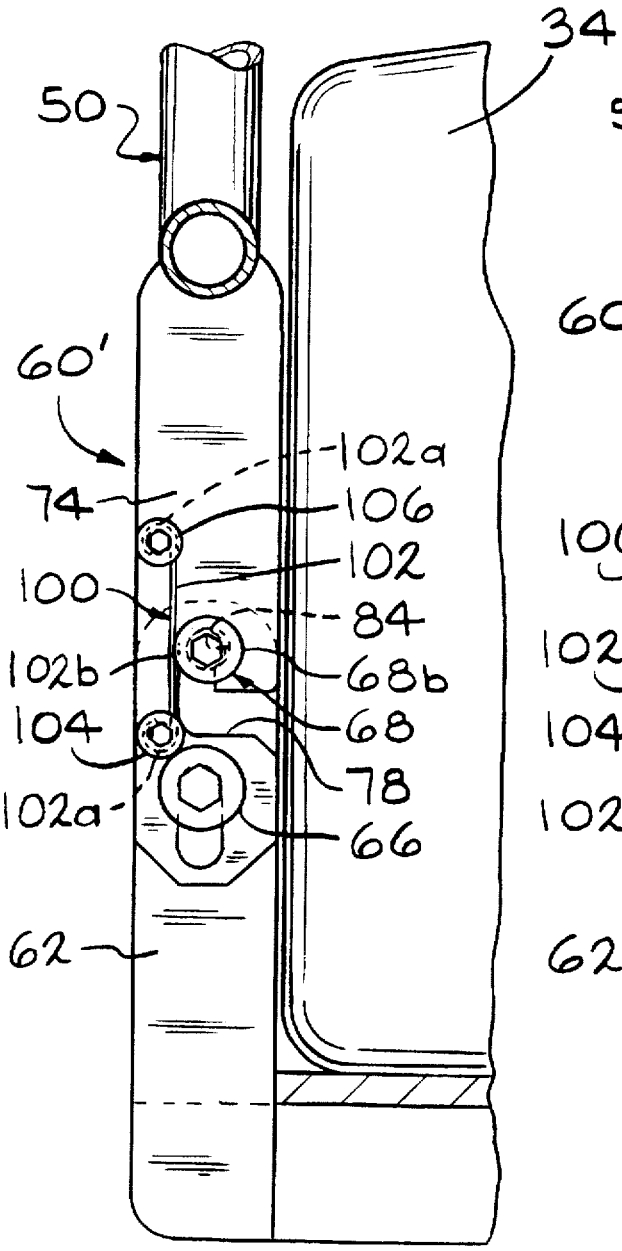
FIG. 7 is a sectional view of the side rail including a second embodiment of a hinge assembly, in accordance with the present invention, wherein the hinge assembly is shown in a raised locked position.

FIG. 7 illustrates a second embodiment of a hinge assembly, indicated generally at 60', in accordance with the invention. The hinge assembly 60' is similar to the hinge assembly 60 described above, and like reference numbers are used to indicate corresponding components. The hinge assembly 60' includes a spring assembly 100 which assists in retaining the side rail 50 in the raised locked position, as illustrated in FIG. 7. The spring assembly 100 includes an elongated spring strap 102 preferably made of a material having resilient characteristics, such as spring steel. The spring strap 102 extends between a pair of mounting pins 104 and 106 which are fastened to the second support member 74. The spring strap 102 has ends 102a which are fastened to the mounting pins 104 and 106. The ends 102a of the spring strap 102 can be fastened to the mounting pins 104 and 106 by any sufficient manner, such as by forming the ends 102a into a hook-shape which are wrapped around the mounting pins 104 and 106. A central portion 102b of the spring strap 102 is positioned adjacent the head 68b of the upper pin 68 so that the upper pin 68 is positioned or "sandwiched" between the spring strap 102 and the wall of the recess 84 of the open slot 78.

In desired, the spring strap 102 can be in tension or slightly deflected when the side rail 50 is in the raised locked position so that the spring strap 102 acts against the head 68b of the upper pin 68, thereby urging the wall of the recess 84 of the second support member 74 against the upper pin 68 to retain the side rail 50 in the raised locked position.

Figure 8:
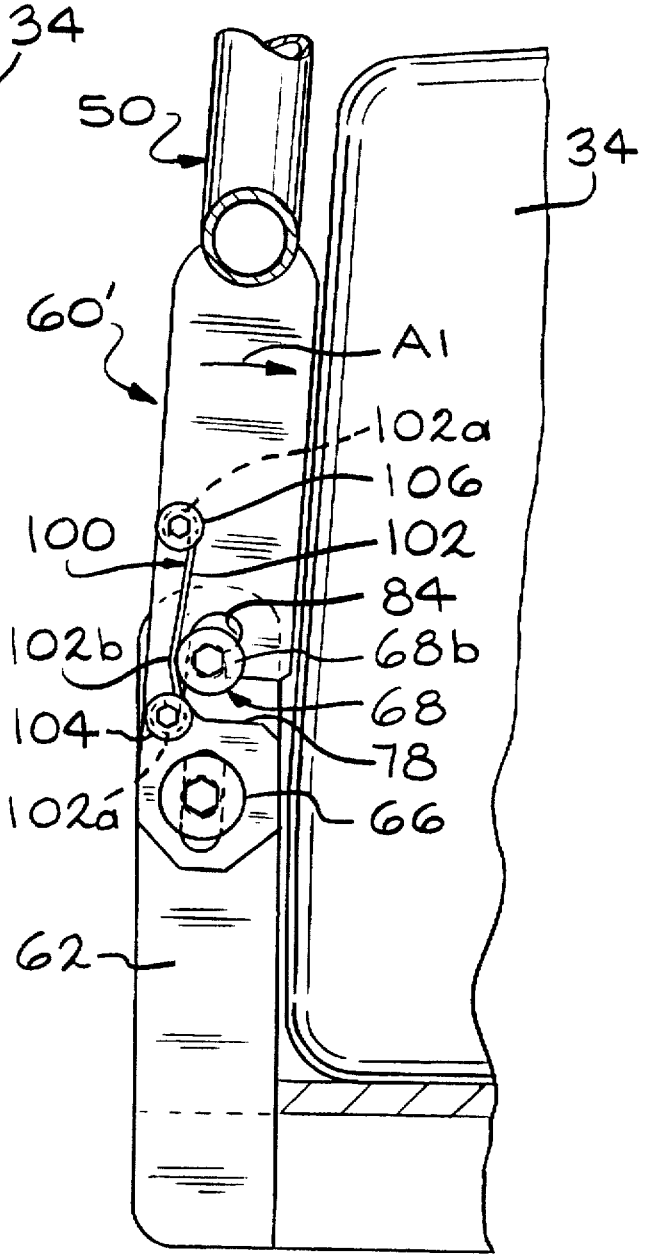
FIG. 8 is a sectional view of the side rail showing the hinge assembly of FIG. 7 in a pivoted unlocked and lifted position.

To disengage the side rail 50 from the raised locked position, the side rail 50 is first pivoted about the lower pin 66 and slightly rotated in a clockwise direction as shown by arrow A1, as viewing FIG. 7. The movement of the side rail 50 causes the head 68*b* of the upper pin 68 to further engage the central portion 102*b* of the spring strap 102, thereby deflecting the spring strap 102 in a direction outwardly from the upper pin 68. The side rail 50 can then be lifted in a generally vertical direction, as illustrated in FIG. 8, and moved to the lowered position by the same method as described above with respect to the side rail 50 with the hinge assembly 60.

Figure 9:
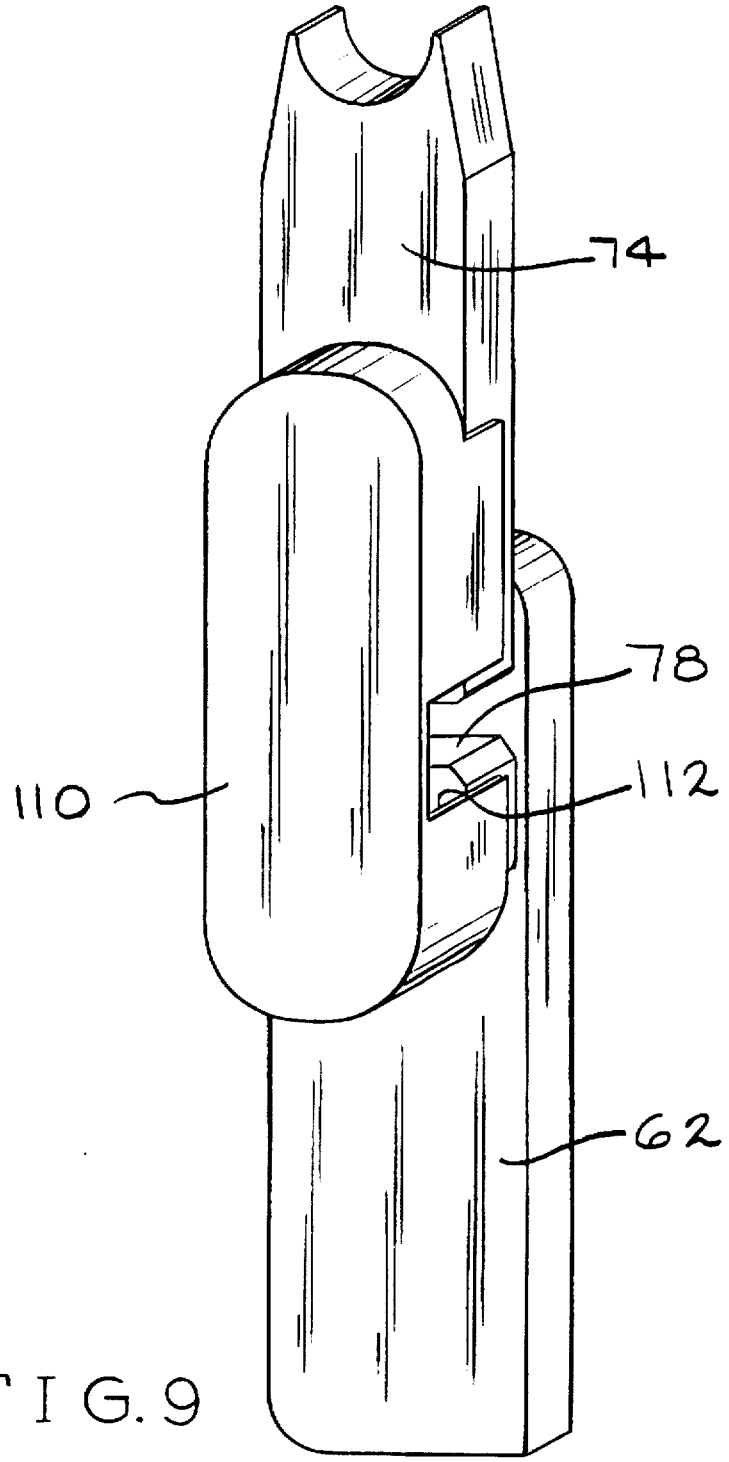
FIG. 9 is a perspective view of a protective cover for use with the hinge assembly.

FIG. 9 illustrates a protective cover 110 for concealing the hinge assemblies 60 and 60'. Preferably, the cover 110 is fastened to the second support member 74 and includes an opening 112 for allowing passage of the upper pin 68 through the cover 110 when the side rail 50 is moved from the raised position to the lowered position. The cover 110 can be fastened to the second support member 74 by any suitable means, such as by the use of threaded fasteners, spot welding, adhesives, or friction fittings. The cover 110 can be made of any suitable material, such as plastic or metal.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A hinge assembly adapted for use with a bed having a side rail, said hinge assembly comprising:

a first member adapted to be secured to the bed;

a second member adapted to be secured to the side rail, said second member pivotally connected to and movable between a first position and a second position with respect to said first member, said second member having first and second spaced apart slots formed therein;

a first pin fastened to said first member and extending therefrom through said first slot of said second member thereby pivotally supporting said second member relative to said first member; and a second pin fastened to said first member and extending therefrom, said second pin being disposed within said second slot when said second member is in said first position to prevent movement between said first and second members.

2. The hinge assembly defined in claim 1 wherein said second slot has a first branch and a second branch extending from said first branch to a side of the second member thereby forming an opening.

3. The hinge assembly defined in claim 2 wherein said second branch of said second slot extends in a direction which is approximately perpendicular to said first direction.

4. The hinge assembly defined in claim 2 wherein said second member has a recess formed in said first branch of said second slot, said recess adapted for receiving said second pin when said second member is in said first position.

5. The hinge assembly defined in claim 1 further including a spring assembly for urging said second pin against a wall of said second slot when said side rail is in said first position.

6. The hinge assembly defined in claim 5 wherein said spring assembly includes a resilient spring strap supported between a pair of mounting pins fastened to said second member, said spring strap having a central portion which is positioned adjacent said second pin.

7. A bed for a person comprising:

a frame;

a mattress supported by said frame, said mattress having a side and a top surface; and a side rail; and a hinge assembly pivotally attaching said side rail to said frame, said hinge assembly comprising:

a first member secured to said frame of said bed;

a second member secured to said side rail, said second member pivotally connected to and movable between a first position and a second position with respect to said first member, said second member having first and second spaced apart slots formed therein;

a first pin fastened to said first member and extending therefrom through said first slot of said second member thereby pivotally supporting said second member relative to said first member; and a second pin fastened to said first member and extending therefrom, said second pin being disposed within said second slot when said second member is in said first position to prevent movement between said first and second members.

8. The bed defined in claim 7 wherein said bed is a bed enclosure, said bed enclosure including a frame having four upright posts defining a pair of generally vertical opposed side walls and a pair of generally vertical opposed end walls.

9. The bed defined in claim 7 wherein said side rail includes a framework having at least two horizontally extending rails and at least two vertically extending members connected to said horizontally extending rails.

10. The bed defined in claim 7 wherein said side rail is covered by a padding.

11. The bed defined in claim 7 wherein said second slot of said second member has a first branch and a second branch extending from said first branch to a side of the second member thereby forming an opening.

12. The bed defined in claim 11 wherein said second branch of said second slot extends in a direction which is approximately perpendicular to said first direction.

13. The bed defined in claim 11 wherein said second member has a recess adapted for receiving said second pin when said second member is in said first position.

14. The bed defined in claim 7 wherein said hinge assembly includes a spring assembly for urging said second pin against a wall of said second slot when said second member is in said first position.

15. The bed defined in claim 14 wherein said spring assembly includes a resilient spring strap supported between a pair of mounting pins fastened to said second member, said spring strap having a central portion which is positioned adjacent said second pin.

16. A hinge assembly adapted for use with a bed having a side rail comprising:

a first support member adapted to be secured to the bed;

a second support member adapted to be secured to the side rail, said second support member pivotally supported relative to said first support member and movable relative to said first support member between a raised position and a lowered position, said second support member having first and second spaced apart slots formed therein;

a first pin fastened to said first support member and extending therefrom through said first slot of said second support member thereby pivotally supporting said second support member relative to said first support member for movement between said raised position and said lowered position; and a second pin fastened to said first support member and extending therefrom, said second pin disposed within said second slot of said second support member when said second support member is in said raised position to prevent relative movement between said first and second support members.

17. The hinge assembly defined in claim 16 wherein said second slot has a first branch extending in first direction and a second branch extending from said first branch in a second direction to a side of said second support member thereby forming an opening in said second slot.

18. The hinge assembly defined in claim 16 wherein said second slot has a recess formed therein, said recess adapted to receive said second pin when said second support member is in said raised position.

19. The hinge assembly defined in claim 16 further including a spring assembly for urging said second pin against a wall of said second slot when said second support member is in said raised position.

20. The hinge assembly defined in claim 16 further including a cover fastened to said second support member, said cover adapted to conceal said first and second pins and said first and second slots when said second support member is in said raised position.

* * * * *